US005365946A

United States Patent [19]

McMillan

[11] Patent Number: 5,365,946

[45] Date of Patent: Nov. 22, 1994

[54] QUICK RELEASE TETHER FOR MOUTHGUARDS

[75] Inventor: Norm J. V. McMillan, Plymouth, Minn.

[73] Assignee: E-Z Gard Industries, Inc., Minneapolis, Minn.

[21] Appl. No.: 933,484

[22] Filed: Aug. 21, 1992

[51] Int. Cl.[5] ..... A61C 5/14

[52] U.S. Cl. ..... 128/861; 128/862

[58] Field of Search ..... 128/859–862, 128/62 R; 2/2

[56] References Cited

U.S. PATENT DOCUMENTS

| | | | |
|---|---|---|---|
| 2,669,988 | 2/1954 | Carpenter | 128/861 |
| 2,694,397 | 11/1954 | Herms | 128/861 |
| 2,847,003 | 8/1958 | Helmer | 128/861 |
| 3,058,462 | 10/1962 | Greenblum | 128/861 |
| 3,082,765 | 3/1963 | Helmer | 128/861 |
| 3,107,667 | 10/1963 | Moore | 128/861 |
| 3,124,129 | 3/1964 | Grossberg | 128/862 |
| 3,203,417 | 8/1965 | Helmer | 128/861 |
| 3,223,085 | 12/1965 | Gores et al. | 128/136 |
| 3,312,218 | 4/1967 | Jacobs | 128/862 |
| 3,407,809 | 10/1968 | Ross | 128/861 |
| 3,411,501 | 11/1968 | Greenberg | 128/862 |
| 3,448,738 | 6/1969 | Berghash | 128/861 |
| 3,485,242 | 12/1969 | Greenberg | 128/862 |
| 3,496,936 | 5/1970 | Gores | 128/136 |
| 3,513,838 | 5/1970 | Foderick et al. | 128/861 |
| 3,518,988 | 12/1970 | Gores | 128/136 |
| 3,682,164 | 8/1972 | Miller | 128/861 |
| 3,692,025 | 9/1972 | Greenberg | 128/861 |
| 3,768,465 | 10/1973 | Helmer | 128/862 |
| 3,864,832 | 2/1975 | Carlson | 128/136 |
| 3,943,924 | 3/1976 | Kallestad et al. | 128/861 |
| 4,044,762 | 8/1977 | Jacobs | 128/136 |
| 4,063,552 | 12/1977 | Going et al. | 128/136 |
| 4,114,614 | 9/1978 | Kesling | 128/861 |
| 4,337,765 | 7/1982 | Zimmerman | 128/136 |
| 4,376,628 | 3/1983 | Aardse | 128/861 |
| 4,672,959 | 6/1987 | May et al. | 128/136 |
| 4,791,941 | 12/1988 | Schaefer | 128/861 |
| 4,867,147 | 9/1989 | Davis | 128/859 |
| 4,977,905 | 12/1990 | Kittelsen | 128/861 |
| 5,117,816 | 6/1992 | Shapiro | 128/861 |

OTHER PUBLICATIONS

"Mouth Protectors: Give Your Teeth A Sporting Chance": 1985 Am. Dental Assn. & Academy of Sports Dentistry.

"Muscular Strength Correlated to Jaw Posture And The The Temporomandibular Joint" by Steven D. Smith D.M.D. NYS Dental Journal, vol. 44, No. 7 Aug.–Sep. 1978.

*Primary Examiner*—Michael A. Brown

*Attorney, Agent, or Firm*—Palmatier, Sjoquist & Helget

[57] ABSTRACT

A mouthguard releasable in-line tether assembly including a forwardly extending tether-connecting tab extending from an anterior portion of a mouthguard. The anterior portion has a forward end adapted to releasably receive and hold a breakaway tab fastener in parallel or in-line arrangement with the tab. The tab fastener is pivotally held by a stiff tether to permit pivotal movement of the fastener along a first axis perpendicular to both the tab and the tether. The tether further has a face mask end adapted to pivotally hold a face mask catch connectable to a face mask and to permit pivotal movement of the tether along a second axis parallel to the first axis.

21 Claims, 3 Drawing Sheets

QUICK RELEASE TETHER FOR MOUTHGUARDS

BACKGROUND OF THE INVENTION

This invention relates generally to a protective mouthguard for use in athletics and more particularly, to a mouthguard releasable in-line tether assembly.

A number of mouthguards currently exist in the art of protecting the teeth, gums, lips, jaws, and temporal mandibular joints. Mouthguards are designed to reduce the chance of shock, concussions, abrasions, and other injuries as a result of high impact collisions and blows during athletic competition.

In general, mouthguards can be placed into two broad categories: tethered and untethered. Untethered mouthguards are commonly fabricated by dentists to fit the exact contour of the user's teeth or are manufactured in a single configuration with the user trimming the mouthguard to the correct size with a scissors and then molding the mouthguard to his or her teeth after softening the mouthguard in boiling water.

In athletic activities which utilize a helmet or other protective headgear with a face mask, and in particular in a high impact sport such as football and hockey, it is desirable for the mouthpiece to be tethered to the helmet or the face mask. The principle reasons are twofold. First, having the mouthguard tethered to the helmet or face mask eliminates the chance that the mouthguard will be lost or misplaced. Secondly, and perhaps most important, a number of instances have arisen where the user inadvertently swallows the mouthguard as a result of impact or otherwise during activity. This can result in the user choking on the mouthpiece, thus causing severe injury or death.

Tethered mouthguards or mouthpieces that currently exist in the art are generally of a one-piece construction or of a construction wherein the tether is removable from the mouthguard. The one-piece constructions generally comprise a moldable mouthpiece and integrally formed tether strap constructed of the same material as the mouthpiece and extending from the mouthpiece for connection to the headgear, helmet or face mask. This type of construction poses a problem if the helmet is removed from the user as a result of a high impact collision or the like. The mouthpiece is then violently pulled from the user's mouth, possibly giving rise to serious injury. This version of tethered mouthguard typically has their tethers constructed of integral stiff and cumbersome straps that have relatively limited flexibility. Consequently, these versions of tethered mouthguards are not comfortable apart from being potentially dangerous.

The second type of releasable tether and mouthguard assemblies typically has the tether constructed of a uniquely different material apart from the mouthguard. The consequence this construction is that the mouthguard may freely swing about and twist on the tether as the mouthguard dangles from the headgear or face mask. This arrangement confounds the user in that he or she experiences difficulty in properly orientating the mouthpiece for insertion into the mouth as the mouthguard may be twisted about the tether or improperly aligned. Another problem with releasable tethers that are connected to the mouthguard is that they require significant force which may be defined as multiple vector forces required to release or breakaway the tether from the mouthguard.

There is a need for a mouthguard releasable tether assembly that properly keeps the mouthguard in proper orientation for quick insertion into the user's mouth while yet exhibits quick release aspects for safety purposes.

SUMMARY OF THE INVENTION

A mouthguard releasable in-line tether assembly comprises a forwardly extending tether-connecting tab extending from an anterior portion of a mouthguard. The anterior portion has a forward end adapted to releasably receive and hold a breakaway tab fastener in parallel or in-line arrangement with the tab. The tab fastener is pivotally held by a stiff tether to permit pivotal movement of the fastener along a first axis perpendicular to both the tab and the tether. The tether further has a face mask end adapted to pivotally hold a face mask catch connectable to a face mask and to permit pivotal movement of the tether along a second axis parallel to the first axis.

A principle object and advantage of the present invention is that the tether assembly properly supports the mouthguard in-line or in proper orientation for correct insertion into a user's mouth while yet allowing the mouthguard to pivot outwardly and downwardly when not in use.

Another object and advantage of the present invention is that the tether assembly is in-line or parallel with the overall tether and mouthguard tab assembly thereby requiring a lesser force for facilitating the breakaway of the tab and fastener should the face mask be moved away from the user's face.

Another object and advantage of the present tether assembly is that is it relatively stiff and prohibits the mouthguard portion and tether from twisting and swinging about which would inhibit quick and proper orientation into the mouth.

Yet another object and advantage of the present invention that it permits pivotal movement along two parallel axes, thereby permitting comfortable wear of a mouthguard utilizing the present tether assembly without the discomfort of prior art stiff tethers.

Another object and advantage of the present invention is that the releasable tether assembly easily releases along a parallel line as opposed to the necessary multiple vector forces required to breakaway prior art releasable tether assemblies.

Yet another advantage and object of the present invention is that the user requires minimal time to grasp the downwardly suspended properly oriented mouthguard and insert it into his or her mouth for the commencement of athletic activity or competition.

DETAILED SPECIFICATION

Figures 1, 2:
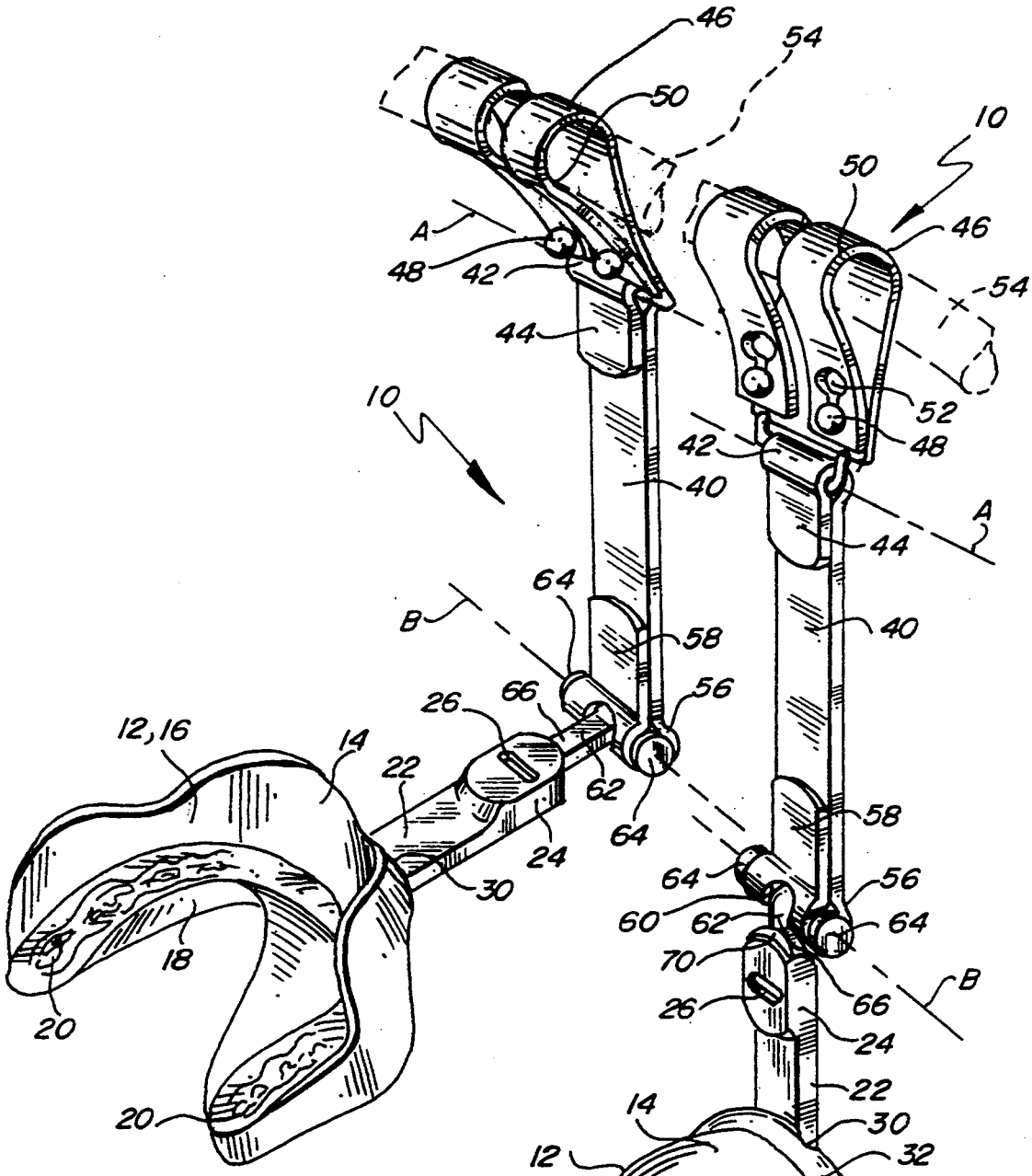
FIG. 1 is a perspective view of the mouthguard releasable in-line tether assembly connected to a face mask in broken outline and positioned as if inserted within the user's mouth.
FIG. 2 is a perspective view similar to FIG. 1 with the mouthguard suspended downwardly and properly oriented for ready insertion into the user's mouth.
Figure 3:
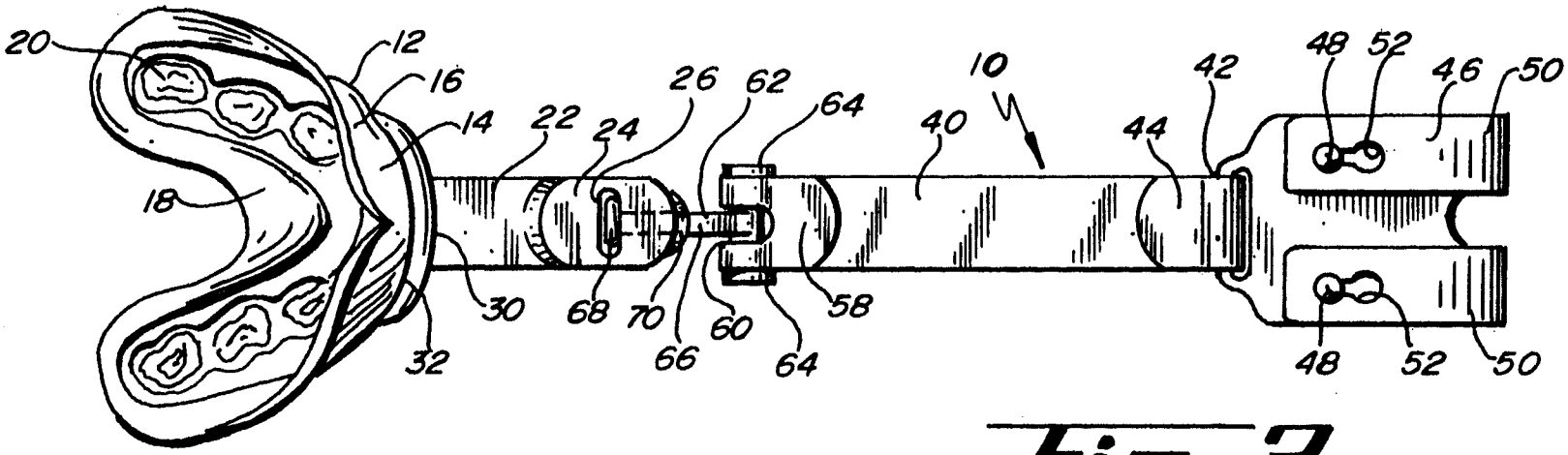
FIG. 3 is a top plan view of the assembly.

Referring to FIGS. 1–7, the mouthguard releasable in-line tether assembly 10 may generally be seen. The tether assembly 10 generally includes the U-shaped mouthguard portion 12 which supports a forwardly directed connecting tab or handle 23 suitably integral with the mouthpiece portion 12. The tab 22 has a reinforced forward end 24. An in-line releasable relatively stiff tether 40 is provided supporting a face mask or face guard catch 46 for attachment thereto. The other end of the tether 40 supports a T-shaped breakaway tab fastener. The reinforced forward end 24 of the tab 22 is suitably adapted to releasably hold the fastener 62 in an in-line arrangement therewith.

More specifically, the mouthguard portion 12 is generally U-shaped and designed for insertion into the mouth. The mouthguard portion 12 has an anterior portion 14 with a forward or outer protective flange 16 and a reward inner protective flange 18 with a protective web or channel 20 therebetween. The mouthguard 12 is designed for protective engagement with the teeth and is suitably made of thermoplastic material such as Ethylene Vinyl Acetate (EVA) suitably manufactured and identified as Dupont's Elvax No. 250 or Union Carbide DQDA No. 3269.

Extending forwardly from the anterior portion 14 of the mouthguard 12 is the forward connecting tab or handle 22 which appropriately is integral and of the same material as mouthguard portion 12. Tab 22 is appropriately stiff as it will readily support the mouthguard in a horizontal posture when held by hand. The tab 22 has a reinforced forward end 24 suitably with a central cavity or opening 26 with a first dimension$_{opening}$. From the central cavity 26 and directed forwardly or anteriorly is a reduced forward tunnel passageway 28 suitably also of a second dimension$_{tunnel}$. The rearward end 30 of tab 22 is appropriately affixed by way of initial molding or heat fusion and thereafter attaching to the anterior portion 14 of the mouthguard 12. The rearward end 10 may also support an anterior impact brace 32 which is suitably affixed or integral with the anterior portion of the mouthguard 12.

Figure 8:
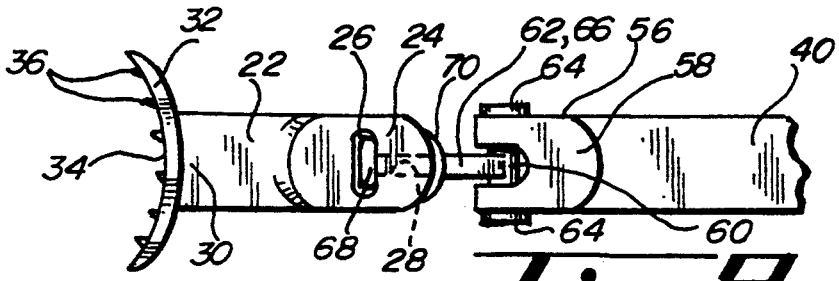
FIG. 8 is a top plan view of the tether assembly further including an anterior impact brace.
Figure 9:
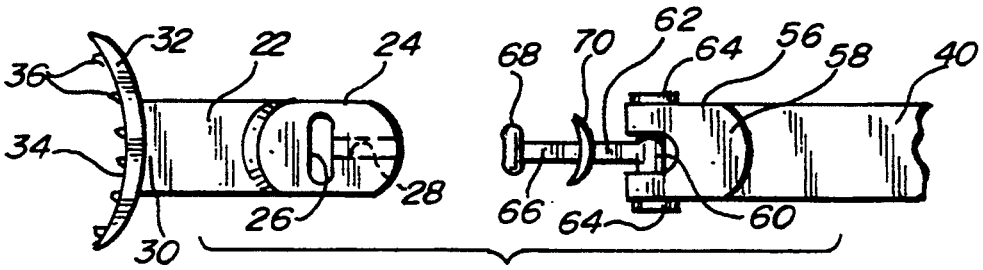
FIG. 9 is a similar view to FIG. 8 with the tether and mouthguard tab portion released or broken away.
Figure 4:
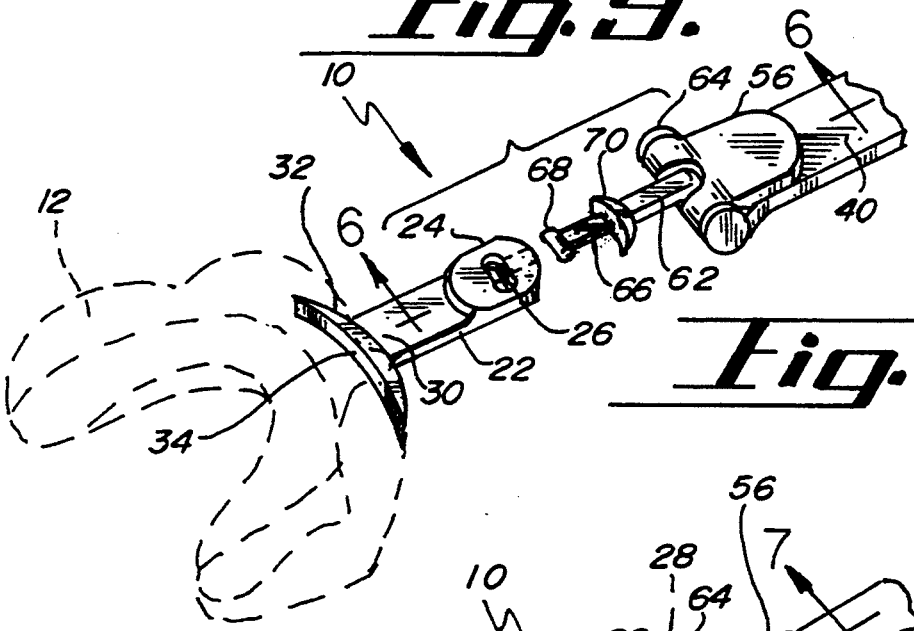
FIG. 4 is a perspective view of the invention with the tether partially broken away and released from the mouthguard with portions shown in broken outline.
Figure 5:
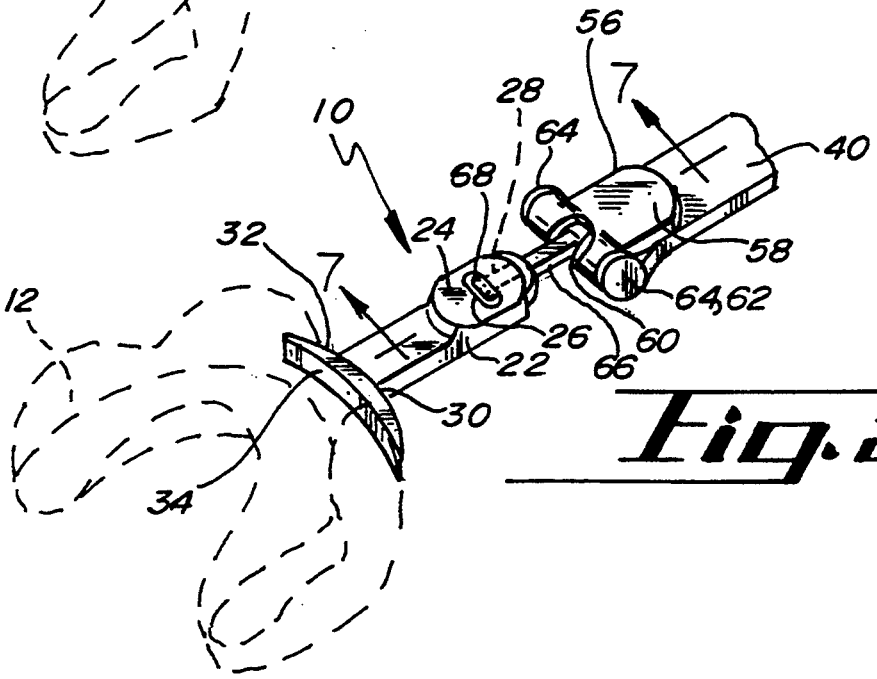
FIG. 5 is a perspective view of the tether partially broken away connected to the mouthguard tab, wherein the mouthguard is shown in broken outline.

As shown on FIGS. 8 and 9, the anterior impact brace may have an innerface 34 supporting material spikes or protuberances 36. Spikes 36 are present and susceptible for heat as to provide melted material in affixing the anterior impact brace 32 to the anterior portion of mouthguard 12.

The in-line releasable tether 40 is suitably made of a cotton or nylon webbing that is flat, stiff and relatively inflexible in that it will remain in-line and not twist. The tether 40 appropriately may also be coated with vinyl, plastic or rubber. The tether 40 appropriately has a face mask end 42 supporting loops 44 which are turned back upon the tether 40 and sonically welded, glued or sewn thereat as to capture the face mask or face guard attachment, catch, buckle or snap 46 which suitably may be made of styrene. The catch supports snap knobs 48. Loops 50 extend from the catch 46 and appropriately have loop openings 52 for capture of the snap knobs 48 as to secure the catch or snap 46 about a face mask or face guard bar 54 shown in broken outline. By this arrangement, the tether assembly 10 suitably may pivot along first pivot axis A.

Releasable tether 40 also supports a mouthguard end 56 with a loop 53 thereat having a central loop opening 16 as to capture T-shaped breakaway tab fastener 62 suitably made of styrene. The loop 58 suitably may be sonic welded, glued, or sewn as to capture the fastener 62 at the tether end 56. Loop 58 suitably captures the tab fastener 62 while the retaining shoulder 64 keep the fastener 62 positioned within the loop 58 and finger 66 extends outwardly from the central loop opening 60. At the end of finger 66 is an enlarged end knob 68 suitably of a third dimension$_{knob}$. Along finger 66 but before end knob 68 is a break collar 70.

Figure 6:
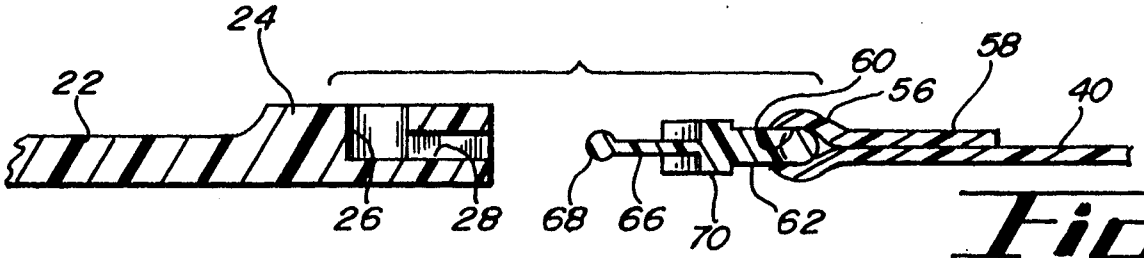
FIG. 6 is a cross-sectional view taken along line 6—6 of FIG. 4.
Figure 7:
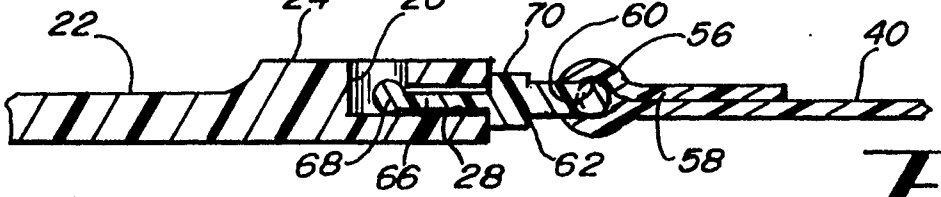
FIG. 7 is a cross-sectional view taken along line 7—7 of FIG. 5.

As clearly seen in cross-section in FIGS. 6 and 7, the first dimension$_{opening}$ of the central cavity or opening 26 is larger than the third dimension$_{knob}$ of the end knob 68 while the third dimension$_{knob}$ is less than that of the second dimension$_{tunnel}$ of the passageway 28. It is clear from FIGS. 6 and 7 that all releasable connecting elements of the tether assembly 10 are in-line or parallel with respect to each other. By this arrangement, the quick release or breakaway feature of the tether assembly is greatly simplified and only a force along the same plane as the rest of the assembly 10 is required to breakaway the assembly 10. This is a significant advantage over the prior art breakaway tethers which often require downward or upward forces to safely breakaway the mouthguard portion 12 from the tether 40 when the helmet is disengaged from the user's head to prevent injury.

In operation, the tab fastener 72 has its fingers 66 and end knobs 68 fed into the tunnel or passageway 28 until the end knob 68 snaps into the central cavity or opening 26 and is held thereat and further secured by way of the break collar 70. Referring to FIGS. 1 and 2, it man be observed that the tether assembly 10 freely pivots about parallel axes A and B as the assembly 10 is supported by face mask bar 54. FIG. 2 shows the assembly in its free-hanging condition suspended from the face mask 54. The user simply may grasp the tab 22 and pivot it upward into the position shown in FIG. 1 as if inserted into the user's mouth. While the mouthguard releasable tether assembly 10 is free to swing along axes A and B, it is always maintained or oriented in proper condition for quick grasping and inserting into the user's mouth.

Although the description of the preferred embodiment has been quite specific, it is contemplated that various modifications could be made without deviating from the spirit of the invention. Accordingly, it is intended that the present invention and its scope be dictated by the appended claims rather than by the preferred embodiment.

I claim:

1. A mouthguard releasable in-line tether assembly, comprising:

a) a forwardly extending tether connecting tab adapted to connect and extend from an anterior portion of a mouthguard, the tab having a forward end adapted to releasably receive and hold a breakaway tab fastener in parallel, in-line arrangement with the tab; and b) a stiff tether having a mouthpiece end adapted to pivotally hold the tab fastener and to permit pivotal movement of the fastener along a first axis perpendicular to both the tab and the tether, the tether having a face mask end adapted to pivotally hold a face mask catch connectable to a face mask and to permit pivotal movement of the tether along a second axis parallel to the first axis thereby keeping the mouthguard in-line and properly oriented for correct insertion into a user's mouth and facilitating breakaway of the tab and fastener should the face mask be moved away from the user's face.

2. The assembly of claim 1, wherein the forward end of the tab has a central cavity with a reduced forwardly extending passageway from the cavity through to the forward end.

3. The assembly of claim 2, wherein the breakaway tab fastener has an extending finger with an end knob wherein the knob and finger may be forced into the tab passageway until the central cavity captures and releasably holds the knob.

4. The assembly of claim 3, wherein the tab fastener is T-shaped.

5. The assembly of claim 3, wherein the tab fastener is made of rigid material.

6. The assembly of claim 1 wherein the stiff tether is made of non-elastic material resistant to twisting.

7. The assembly of claim 1 wherein the tab and the mouthguard are made of a compressible thermal plastic material.

8. The assembly of claim 1, further comprising an anterior impact brace between a rearward end of the tab and the anterior portion of the mouthguard.

9. A mouthguard releasable in-line tether assembly, comprising:

a) a forward extending tether connecting tab adapted to connect and extend from an anterior portion of a mouthguard, the tab having a forward end with a central cavity with a reduced forwardly extending passageway from the cavity through to the forward end, a breakaway tab fastener with an extending finger having an enlarged end knob, wherein the knob and finger may be forced into the tab passageway until the central cavity captures and holds the finger knob in a parallel in-line arrangement with the tab; and b) a stiff, twist-resistant tether having a mouth piece end adapted to hold the tab fastener and a face mask end connectable to a face mask thereby keeping the mouthguard in-line and properly oriented for correct insertion into a user's mouth and facilitating breakaway of the tab and the fastener should the face mask be moved away from the user's face.

10. The assembly of claim 9 wherein the tab fastener is T-shaped.

11. The assembly of claim 9 wherein the tab fastener is made of rigid material.

12. The assembly of claim 9 wherein the stiff tether is made of non-elastic material resistant to twisting.

13. The assembly of claim 9 wherein the tab and mouth guard are made of a compressible thermal plastic material.

14. The assembly of claim 9, further comprising an anterior impact brace between a rearward end of the tab and the anterior portion of the mouthguard.

15. A mouthguard releasable in-line tether assembly, comprising:

a) a forward extending tether connecting tab adapted to connect and extend from an anterior portion of the mouthguard, the tab having a forward end with a central cavity with a reduced forwardly extending passageway from the cavity through to the forward end, a breakaway tab fastener with a extending finger having an enlarged end knob wherein the knob and finger may be forced into the tab passageway until the central cavity captures and holds the finger knob in a parallel in-line arrangement with the tab; and b) a stiff tether having a mouthpiece end adapted to pivotally hold the tab fastener and to permit pivotal movement of the fastener along a first axis perpendicular to both the tab and the tether, the tether having a face mask end adapted to pivotally hold a face mask catch connectable to a face mask and to permit pivotal movement of the tether along a second axis parallel to the first axis thereby keeping the mouthguard in-line and properly oriented for correct insertion into a user's mouth and facilitating breakaway of the tab and fastener should the face mask be moved away from the user's face.

16. The assembly of claim 15 wherein the tab fastener is T-shaped.

17. The assembly of claim 15 wherein the tab fastener is made of a rigid material.

18. The assembly of claim 15 wherein the stiff tether is made of non-elastic material resistant to twisting.

19. The assembly of claim 15 wherein the tab and mouthguard are made of a compressible thermal plastic material.

20. The assembly of claim 15, further comprising an anterior impact brace between a rearward end of the tab and the anterior portion of the mouthguard.

21. A mouthguard releasable in-line tether assembly for a U-shaped mouthguard with an anterior portion, an outer protective flange and an inner protective flange with a protective channel therebetween, the tether assembly comprising:

a) an arcuate anterior impact brace meltable for attachment to the anterior portion of the outer flange;

b) a stiff twist-resistant tether extending forwardly from the anterior impact brace;

c) a face mask end portion for connecting the tether to a face mask; and d) releasable means facilitating breakaway of the mouthguard with the anterior impact brace from the face mask should the face mask be moved away from the user's face.

* * * * *

UNITED STATES PATENT AND TRADEMARK OFFICE

CERTIFICATE OF CORRECTION

PATENT NO. : 5,365,946

DATED : November 22, 1994

INVENTOR(S) : Norm J.V. McMillan

It is certified that error appears in the above-indentified patent and that said Letters Patent is hereby corrected as shown below:

At Column 1, line 57, after the word "consequence", please insert --of--.

At Column 4, line 39, please delete the word "man", and insert in its place --may--.

Signed and Sealed this

Thirtieth Day of May, 1995

*Attest:*

BRUCE LEHMAN

*Attesting Officer*

*Commissioner of Patents and Trademarks*